US010398940B2

(12) United States Patent
Grosse Austing

(10) Patent No.: US 10,398,940 B2
(45) Date of Patent: Sep. 3, 2019

(54) PROPULSION DEVICE FOR DIVERS AND SWIMMERS

(71) Applicant: Maraneo GmbH, Bochum (DE)

(72) Inventor: Arne Grosse Austing, Bochum (DE)

(73) Assignee: Maraneo GmbH, Bochum (DE)

( * ) Notice: Subject to any disclaimer, the term of this patent is extended or adjusted under 35 U.S.C. 154(b) by 0 days.

(21) Appl. No.: 16/085,582

(22) PCT Filed: Mar. 14, 2017

(86) PCT No.: PCT/EP2017/055914
§ 371 (c)(1),
(2) Date: Sep. 16, 2018

(87) PCT Pub. No.: WO2017/157889
PCT Pub. Date: Sep. 21, 2017

(65) Prior Publication Data

US 2019/0091516 A1 Mar. 28, 2019

(30) Foreign Application Priority Data

Mar. 18, 2016 (DE) ..... 10 2016 105 070

(51) Int. Cl.
*A63B 35/12* (2006.01)
*A63B 31/12* (2006.01)
*B63C 11/46* (2006.01)

(52) U.S. Cl.
CPC ..... *A63B 35/12* (2013.01); *A63B 31/12* (2013.01); *B63C 11/46* (2013.01); *A63B 2208/03* (2013.01)

(58) Field of Classification Search
CPC ..... B63C 11/46; A63B 35/12; A63B 31/12; A63B 2208/03
See application file for complete search history.

(56) References Cited

U.S. PATENT DOCUMENTS 3,329,118 A * 7/1967 Strader ..... A63B 35/12 114/315
3,422,787 A * 1/1969 Rush ..... A63B 35/12 114/315

(Continued)

FOREIGN PATENT DOCUMENTS

DE 102008001622 11/2009

OTHER PUBLICATIONS

Internationaler Recherchenbericht und Schriftlicher Bescheid [International Search Report] dated Jun. 26, 2017 From the Internationalen Recherchenbehörde [International Searching Authority] Re. Application No. PCT/EP2017/055914. (10 Pages).

*Primary Examiner* — S. Joseph Morano
*Assistant Examiner* — Jovon E Hayes

(57) ABSTRACT

The invention relates to a propulsion device, in particular to an underwater propulsion device for divers (1) and swimmers comprising one or several drives (2) provided with electric motors (4) and means (3) for fixing the drives (2) to the legs or arms of the diver (1) or swimmer, wherein the electric motors (4) are provided with a sump cooling, with the electric motors (4) being arranged in waterproof housings (5) and each waterproof housing (5) only being partially filled with a cooling liquid. By arranging the drives (2) on the extremities of the diver (1) or swimmer, the flexibility and mobility are significantly increased; at the same time, the provision of a sump cooling system improves heat dissipation and thus increases the power density.

13 Claims, 3 Drawing Sheets

(56) References Cited

U.S. PATENT DOCUMENTS

| | | | | | |
|---|---|---|---|---|---|
| 3,635,188 | A * | 1/1972 | Rutkowski | A63B 35/12 | 114/315 |
| 3,995,578 | A * | 12/1976 | McCullough | A63B 35/12 | 440/6 |
| 4,467,742 | A * | 8/1984 | Duboy | A63B 35/12 | 114/315 |
| 4,700,654 | A * | 10/1987 | Borges | A63B 35/12 | 114/338 |
| 5,024,178 | A * | 6/1991 | Bruce | A63B 35/12 | 114/315 |
| 5,105,753 | A * | 4/1992 | Chih | A63B 35/12 | 114/315 |
| 5,906,521 | A * | 5/1999 | Tippmann | B63B 35/73 | 114/315 |
| 5,984,739 | A * | 11/1999 | Donahue | A63B 35/125 | 114/315 |
| 6,823,813 | B2 * | 11/2004 | Mazin | B63C 11/46 | 114/315 |
| 8,567,336 | B1 * | 10/2013 | Mazin | A63B 31/12 | 114/315 |
| 9,180,343 | B2 * | 11/2015 | Yeo | B63C 11/46 | |
| 9,327,165 | B2 * | 5/2016 | Melendez | A63B 35/12 | |
| 9,540,090 | B2 * | 1/2017 | Fenu | B63H 25/02 | |
| 9,878,211 | B1 * | 1/2018 | Knowles | A63B 35/00 | |
| 10,071,289 | B1 * | 9/2018 | Robinson | A63C 11/10 | |

* cited by examiner

PROPULSION DEVICE FOR DIVERS AND SWIMMERS

RELATED APPLICATIONS

This application is a National Phase of PCT Patent Application No. PCT/EP2017/055914 having International filing date of Mar. 14, 2017, which claims the benefit of priority of German Patent Application No. 10 2016 105 070.9 filed on Mar. 18, 2016. The contents of the above applications are all incorporated by reference as if fully set forth herein in their entirety.

FIELD AND BACKGROUND OF THE INVENTION

The invention relates to a propulsion device, in particular an underwater propulsion device, for divers and swimmers, said device being provided with one or more drives comprising electric motors, and having means for fixing the drives to the legs or arms of the diver or swimmer.

For faster and fatigue-free movement of a diver under water, diver propulsion vehicles (DPV) are known from the state of the art. They usually have a torpedo shape and are held by the diver with his hands so that the DPV tows the diver through the water. These devices have proved their worth in principle, but the flexibility of the divers is very limited because they can no longer use their arms and hands freely, for example to communicate with other divers, to let air into or out of the jacket (buoyancy compensator), hold a diving lamp, operate the diving computer, take photographs or grab or take hold of objects under water. For this reason, underwater propulsion devices have already been proposed which are attached to the legs, especially to the upper or lower leg of the diver, for example in publications U.S. Pat. Nos. 6,823,813 B2 and 8,567,336 B1.

The drives of dive scooters or underwater propulsion systems call for a comparatively high torque at relatively low speed rates, which is due to the hydrodynamic requirements to be met to enable the propeller to operate efficiently. Therefore, permanently excited synchronous motors are typically used in conventional DPVs, especially internal rotor motors with speed reduction gear. Some internal rotor motors without gears are also known but require more installation space to produce the same torque.

In these drives, the externally arranged stator is often thermally and conductively connected to the inner wall of the housing via the outer shell surface. Since water continuously washes around the housing and due to the fact that the housing of the drive is relatively large, an adequate cooling effect is achieved. The internally mounted rotor of the electric motor is cooled solely by thermal convection and radiation.

The use of drives that are attached to the upper or lower leg of the diver now causes the problem that the surface available for cooling by means of the surrounding water is significantly smaller than the surface available with conventional DPVs. Accordingly, a more effective cooling system is needed.

One possibility to achieve an efficient cooling effect, but for ship propulsion systems, which is described in the German utility model DE 20 2011 109 894 U1, is a flooded electric motor that is continuously flown through by the surrounding liquid. In this way, a very good cooling effect is brought about that is sufficient even for electric motors located inside a small housing. In this context, however, it is problematic that the rotor and stator are continuously exposed to highly corrosive salt water and impurities in the water, especially when diving in the sea. To counteract this, these components must be provided with a polyurethane resin coating or a protective sheathing or cladding consisting of titanium, stainless steel or fiberglass or carbon reinforced plastic material, for example. The use of conventional anti-friction bearings is not possible so that water-lubricated plain bearings must be employed instead. However, these cause higher friction so that greater losses are to be put up with.

Another possibility is the use of an oil-filled electric motor, as described in DE 39 16 253 A1 for submersible pumps which are designed for high-temperature operation with a view to pumping oil or water out of boreholes. In contrast to the variant described hereinbefore, such an electric motor is provided with a watertight housing that is completely filled with oil. However, since the oil heats up during operation a change in volume occurs, so that special pressure equalizing reservoirs have to be provided. Moreover, as a result of the continuous rotation of the components within a viscous fluid, relatively high friction is encountered. Although friction can to some extent be compensated for by providing particularly smooth surfaces and high rotational symmetry of the motor components, this in turn increases the effort involved in manufacturing the electric motor components. What is more, due to the complete oil filling the housing of the drive is unable to produce any buoyancy effect.

Proceeding from what is known from prior art as described hereinbefore it is therefore the objective of the invention to propose and provide a propulsion device that can be attached to the legs or arms of a diver or swimmer and enables sufficient cooling to be produced at high drive power and does not have the previously described disadvantages associated with the state of the art.

SUMMARY OF THE INVENTION

In accordance with the invention, this objective is achieved by a propulsion device for divers and swimmers with one or more drives equipped with electric motors and means for fixing the drives to the legs or arms of the diver or swimmer, with the electric motors having a sump cooling system and said electric motors being arranged in watertight housings and each watertight housing being only partially filled with a cooling liquid.

According to the invention, a sump cooling system is used for the electric motors. For this purpose, a watertight housing, in which the electric motor is located, is filled with a cooling liquid only up to a certain level. The filling level should be selected in such a way that when the motor is at a standstill the rotor is positioned approximately half-way in the cooling sump, i.e. surrounded by coolant. The bearing locations should as well be wetted by the coolant.

When the electric motor and thus the rotor is set in rotation, the cooling liquid is distributed inside the housing and caused to circulate along and over the wall of the housing. The rotation also causes the cooling liquid to be hurled against the stator, thus creating a fine spray mist that wets and cools all areas inside the housing and in this way results in a high cooling effect to be achieved. Compared to a drive that is completely filled with oil, the friction losses are considerably lower; in addition, a pressure equalizing tank need not be provided. Since the housing is only partially filled with coolant, there is still a relatively high static buoyancy. The filling level is selected to make sure the most effective heat dissipation is reached with lowest possible friction losses. The components of the electric motor are not suffering from contact with highly corrosive salt water, as is the case with electric motors, through which the surrounding water flows. Also, there is no need for special protection of the components by means of relevant sheathing or coating systems. Finally, the use of water-lubricated plain bearings that are causing higher friction than conventional antifriction bearings can be dispensed with as well.

It has also been found that the cooling liquid is distributed so well by the movement of the rotor that, in general, a separate device for distributing, spreading or spraying the coolant can also be dispensed with. The invention thus relates in particular to propulsion devices with electric motors that are not provided with such a device for the distribution or spraying of the cooling liquid. Furthermore, and as proposed by the present invention, a cooling liquid circuit, a circulation pump, other pumps for pumping coolant or similar media can also be waived.

Generally speaking, a gearbox, typically a reduction gear for conventional diver propulsion vehicles, can be dispensed with as well. Due to the fact that undesired vibrations occur in a motor equipped with a gearbox, the inventive propulsion device without gear operates especially quietly.

An electrically non-conductive coolant should preferably be used as the cooling medium. This means that additional insulation of the components of the electric motor is not required. The cooling liquid may be selected to contain antifreeze agents and/or corrosion inhibitors to improve the lifetime of the electric motor. The use of a low-viscosity transformer oil having good tribological properties over the entire relevant temperature range of between approx. 0 and 60° C. is particularly advantageous. Moreover, using a low-viscosity cooling liquid also rules out that the air gap between rotor and stator closes up due to "sticking". In addition, the cooling liquid should be ecologically compatible (water pollution hazard class 1 according to German water law) in order to exclude water pollution hazards in the event of leakage.

It has furthermore turned out that the cooling liquid can remain in the housing when the electric motor is not in use, without this having a negative effect on the functionality of the electric motor. For that reason, a separate drain or storage tank for the cooling liquid need not be provided. This significantly simplifies the construction of the electric motor. In addition, this and the waiver of separate devices/systems for cooling liquid distribution/spraying as well as the omission of a cooling liquid circuit make sure that the electric motor always functions equally well in any position, regardless of its orientation.

The propulsion device in particular is an underwater propulsion system, which is often referred to as a dive scooter, where it is to be noted, however, that conventional dive scooters usually are of different shape. Using the inventive underwater propulsion device or DPV, a diver can move underwater more quickly and effortlessly. In principle, however, the propulsion device can also be used on the water surface, for example by swimmers and those practicing snorkeling. Wherever divers are referred to in this patent application, the relevant statements or comments made there shall be meant to apply equally to persons moving on the water surface or mostly on the water surface.

The drives of the propulsion device are typically provided with at least one propeller, which generates propulsion in the direction of movement of the diver or swimmer. The rotation of the rotor of the electric motor is transmitted to the propeller. Since, as a rule, no gearbox is arranged between the electric motor and the propeller, the propeller can be mounted directly on the shaft of the electric motor. In addition, the propeller also causes a certain flow of water around the housing, which provides additional cooling and ensures heat to be removed. It is also expedient to provide the propellers with a casing or a protective grating, especially at the side of the propeller, to prevent users from coming into contact with the propeller itself and injuring themselves. It goes without saying, of course, that the casing or the protective grating should not impair the propulsion function of the propeller.

Preferably, the electric motors used are external rotor motors. An external rotor is particularly well suited for distributing the cooling liquid within the housing, and in this way ensuring effective cooling. Caused by the rotation of the rotor, the cooling liquid is moved along and circulated over the wall of the housing, which results in heat to dissipate very effectively. The distribution of the cooling liquid is excellent so that separate devices for the distribution or spraying of the coolant are not required as a rule. External rotor motors of the same size allow higher torques to be produced. This means that high power density and thus rapid propulsion can be achieved. In particular, the invention makes the additional use of a reduction gear unnecessary, with such a gear being usually needed when using conventional internal rotor motors in DPVs.

It is advisable for the propulsion device proposed by the invention to have a battery casing arranged separately from the drives, said casing accommodating batteries, typically rechargeable batteries. Due to the separate arrangement of the batteries the size of the housings intended for the drives which are mounted directly on the arms or legs of the diver or swimmer are kept within acceptable limits. For example, freedivers may carry the battery casing on their back similar to a backpack. In the case of scuba divers, the battery casing can also be carried on the back, in front of, to the side or behind the scuba tank (compressed air cylinder). In particular, the battery casing can also be attached to the scuba tank. For this purpose, the battery casing is provided with appropriate means for attaching it to the back or scuba tank, for example an adapter.

By carrying the battery casing on the back, which is comparatively heavy due to the weight of the batteries, the weight is better distributed when moving ashore and thus made easier portable by the diver/swimmer. A better position of the diver/swimmer in the water is achieved in comparison to a placement of the batteries on the belt, for example; the center of gravity in this way is brought more toward the center of the body. Moreover, a back-mounted battery casing is compatible with a scuba tank being carried.

Arranging the batteries in a separate battery casing also has the advantage that no sealing against the housing containing the cooling liquid is required for the drive. In addition, the battery casing can be shaped so as to offer minimum resistance to the flow of water, for example by placing it in a streamlined manner on the back of a diver. In particular, the battery casing can be designed in the shape of a flattened tube which is located closer to the body than a cylindrical tube and in this way offers lower flow resistance.

It is also recommendable to install the electronic control and power system necessary for the operation of the propulsion device in the battery casing. In this way, the total number of enclosures is reduced so that there is no need for additional cables and leads to be arranged between enclosures or housings.

There must be a functional connection between the individual components of the propulsion device which are spatially separated from each other, such a connection being normally established via cables or supply lines. In particular, the battery casing, which, if considered expedient, may also contain the electronic control components, must be connected to the drives in order to supply the drives with power and ensure the drives are properly controlled. All cables and supply lines must of course be suitable for operation in water, that is, they must in particular be impermeable to water.

In addition, the propulsion device is advantageously equipped with a wired or wireless remote control unit. Since the diver or swimmer does not hold the propulsion device directly in his hands, and because the drive is usually attached to his legs, a remote control makes handling much easier. In the event a remote control unit is available for drive control purposes, the diver/swimmer is free from having to reach for the electronic control device, which may be difficult for him to accomplish since it is usually located on the diver's back. Likewise, it is no longer necessary to reach for the drive itself.

In particular, the remote control can be manually held by the diver/swimmer, thus allowing the diver/swimmer to change speed quickly and easily, even with out-stretched arms. If thought expedient, the remote control device may also include an emergency stop switch, an underwater light or other useful accessories such as a dive computer. It is also considered useful to connect the remote control via a cable to the electronic control unit, which is typically located in the battery casing. It is, of course, mandatory that all components of the remote control should be suitable for operation under water, i.e. in particular be sealed to prevent the ingress of water.

The propulsion device shall in particular be provided with drives suitable for fixing to the thighs of the diver or swimmer and shall have appropriate means for fixing them. Since the legs, unlike the arms, are in most cases stretched in the direction opposite to the direction of propulsion, propulsion in the correct direction is generated quasi automatically by having the drives attached to the legs. Normally, the propellers of the drives are in each case located on the foot side of the drive. Moreover, the advantage of fixing the drives to the thighs is that they can be connected without problems to the battery casing, said connection being usually realized by means of cables. For example, if the drives are attached to the thigh and the battery casing is attached to the back of the diver or swimmer or to the scuba tank, the length of the cables connecting the battery casing with the drives will be acceptable. Here, too, it goes without saying that the components used have to be suitable for underwater operation, in particular also for operation in corrosive salt water, and of course be impermeable to water.

The attachment to the thighs (or to other parts of the legs or to the arms) can be achieved by means of suitable straps which should be lashed around the thigh or legs/arms and should be easily detachable, for example using buckles or clasps. The design of the straps should ensure easy tightening, and it is also possible to use Velcro straps in the form of belts wrapped around the legs/arms. It is furthermore possible to arrange a mounting plate or holding bracket to the leg or arm to which the drive is attached. The mounting plate/holding bracket can also be fixed to the leg or arm by means of straps or similar items. In addition, the drives can also be provided with a connection to a belt, buoyancy compensator or other elements of the propulsion device or diving equipment.

Two drives are preferably used of which each is fixed on the two legs, in particular to both thighs of the diver or swimmer. However, it is also possible to provide additional drives, for example an additional drive located on the back of the diver/swimmer or a drive which is attached to the scuba tank.

BRIEF DESCRIPTION OF THE SEVERAL VIEWS OF THE INVENTION

Further elucidation of the invention is provided by way of example through the enclosed figures where FIG. 1 shows a rear view of an underwater propulsion device carried by the diver;

DESCRIPTION OF SPECIFIC EMBODIMENTS OF THE INVENTION

Figure 1:
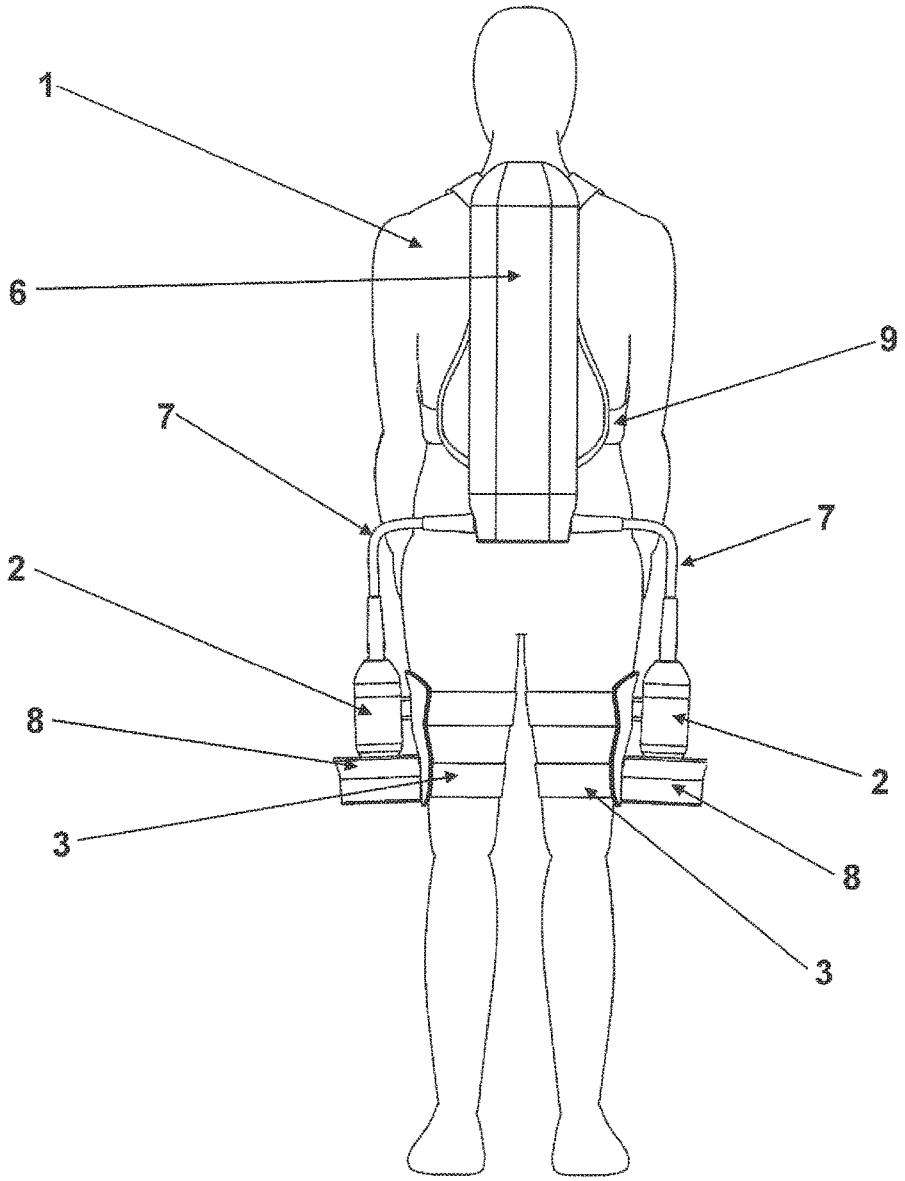

FIG. 1 shows the inventive underwater propulsion device in the rear view as it is carried by a diver 1. Drives 2 are mounted to the side of the thighs, with means 3 for securing the drives 2 on the thighs comprising straps lashed around the thighs, including lateral support for drive 2. The propeller 8 is accommodated in the lower part, that is the foot portion of drive 2.

The two drives 2 are each connected via cable 7 to the battery casing 6, which is carried on the back of the diver 1. A back carrying device 9 is used for this purpose.

Figure 2:
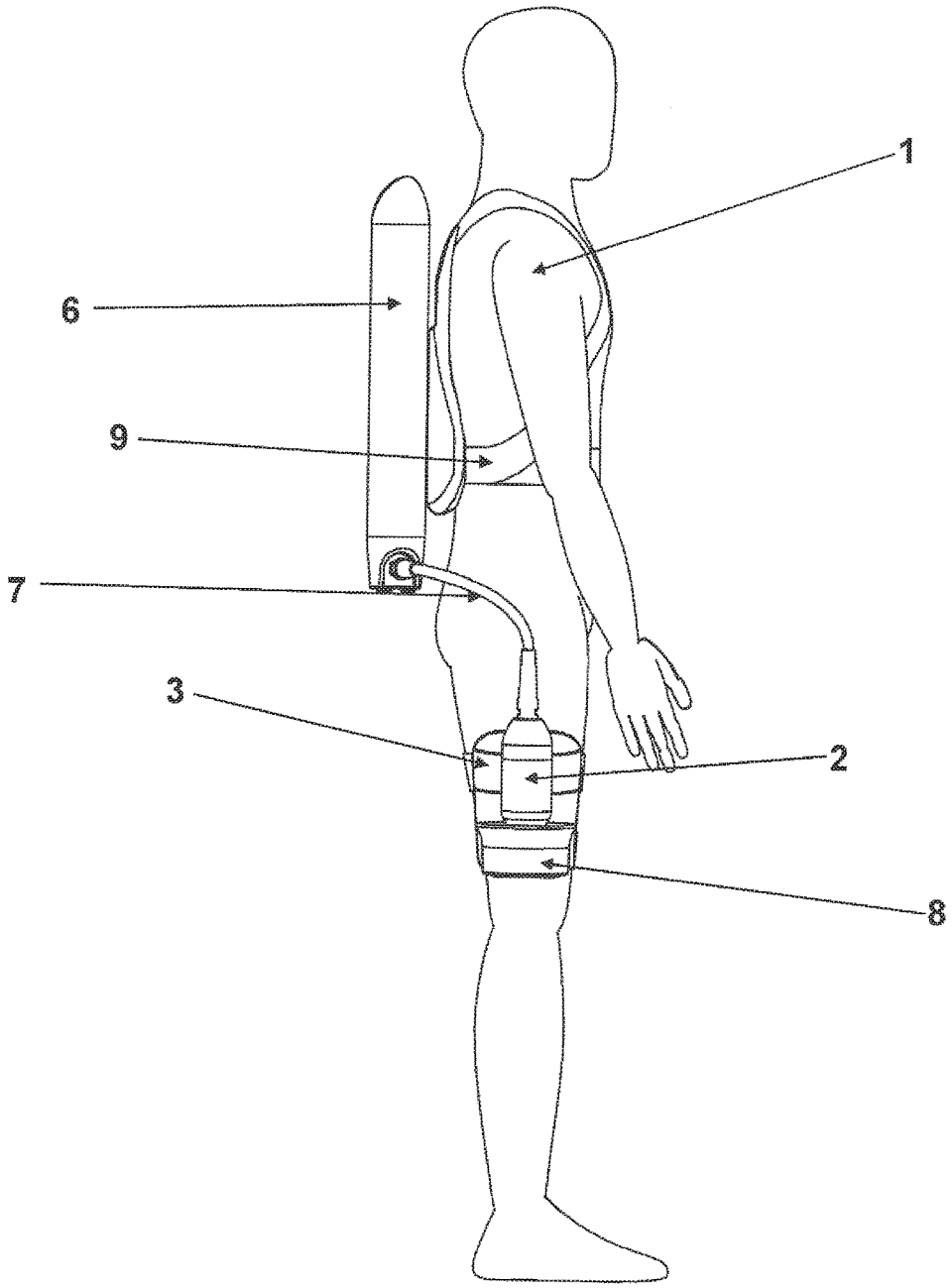
FIG. 2 shows a side view of an underwater propulsion device carried by the diver.

FIG. 2 is a representation of the embodiment of the invention shown as a side view of FIG. 1. It can be seen that the back carrying device 9, here used by a freediver 1 without compressed air cylinder, is designed in the form of a backpack.

Figure 3:
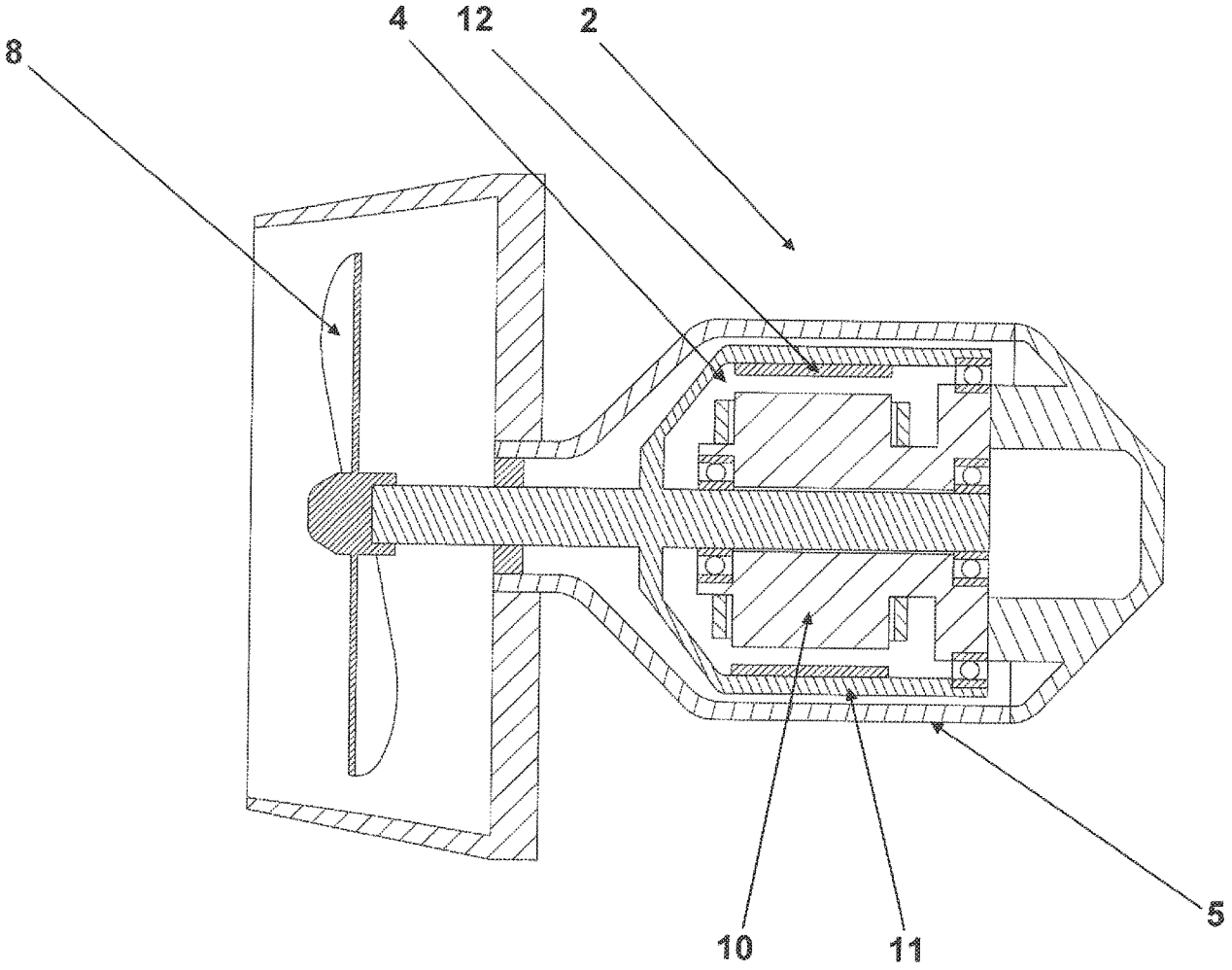
FIG. 3 is a longitudinal section of a drive proposed by the invention.

FIG. 3 shows the actual drive 2 as longitudinal section view. Drive 2 consists of an electric motor 4, which drives the propeller 8 to generate propulsion. The electric motor 4 is mounted in a waterproof housing 5.

Electric motor 4 is an external rotor motor, i.e. rotor 11 is located on the outside, while stator 10 is arranged inside the rotor 11. Rotor 11 is directly connected to propeller 8, which means no gear is used in this embodiment of the invention. In addition, radially aligned magnets 12 can be seen that are attached to the rotor 11 in the form of a ring.

The watertight housing 5 is partially filled with a cooling liquid, which is set into a partly circulating, turbulent motion by the rotor 11 and results in the wetting and cooling of all components of the electric motor 4, including the stationary non-moving stator 10. In this way, even with very powerful electric motors 4 a sufficient cooling effect is

What is claimed is:

1. Propulsion device for divers (1) and swimmers comprising one or more drives (2) provided with electric motors (4) and means (3) for fixing the drives (2) to the legs or arms of the diver (1) or swimmer, characterized in that, the electric motors (4) are provided with a sump cooling, with the electric motors (4) being arranged in waterproof housings (5) and each waterproof housing (5) being only partially filled with a cooling liquid.

2. Propulsion device according to claim 1, characterized in that the cooling liquid is non-conductive electrically.

3. Propulsion device according to claim 1, characterized in that the drives (2) are each provided with at least one propeller (8).

4. Propulsion device according to claim 1, characterized in that the sump cooling does not have a cooling liquid circuit.

5. Propulsion device according to claim 1, characterized in that the sump cooling is not provided with a separate device for the distribution or spraying of the cooling liquid.

6. Propulsion device according to claim 1, characterized in that the cooling liquid remains in the watertight housing (5) of the electric motor (4) when the electric motor (4) is not in operation.

7. Propulsion device according to claim 1, characterized in that the electric motors (4) are external rotor motors.

8. Propulsion device according to claim 1, characterized by a battery casing (6) accommodating the batteries, said casing being arranged separately from the drives (2).

9. Propulsion device according to claim 8, characterized in that an electronic control unit is located in the battery casing (6).

10. Propulsion device according to claim 8, characterized by means for the fixation of the battery casing (6) on the back or the scuba tank of the diver (1) or swimmer.

11. Propulsion device according to claim 1, characterized by a wired or wireless remote control system.

12. Propulsion device according to claim 1, characterized by means (3) for the fixation of the drives (2) to the thighs of the diver (1) or swimmer.

13. Propulsion device according to claim 1, characterized in that the propulsion device is an underwater propulsion device for divers (1).

* * * * *